US011146033B2

(12) United States Patent
Mabuchi

(10) Patent No.: US 11,146,033 B2
(45) Date of Patent: Oct. 12, 2021

(54) MULTICORE CABLE MANUFACTURING METHOD

(71) Applicant: Yazaki Corporation, Tokyo (JP)

(72) Inventor: Miyoshi Mabuchi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 240 days.

(21) Appl. No.: 16/204,208

(22) Filed: Nov. 29, 2018

(65) Prior Publication Data

US 2019/0199048 A1 Jun. 27, 2019

(30) Foreign Application Priority Data

Dec. 25, 2017 (JP) ..... JP2017-247617

(51) Int. Cl.

| | |
|---|---|
| ***H01R 43/048*** | (2006.01) |
| ***H01B 7/08*** | (2006.01) |
| ***H01B 7/00*** | (2006.01) |
| ***H01B 13/06*** | (2006.01) |

(52) U.S. Cl.

CPC ..... *H01R 43/048* (2013.01); *H01B 7/0009* (2013.01); *H01B 7/08* (2013.01); *H01B 13/06* (2013.01); *Y10T 29/49185* (2015.01); *Y10T 29/53217* (2015.01); *Y10T 29/53235* (2015.01)

(58) Field of Classification Search

CPC .... H01R 43/04; H01R 43/055; H01R 43/048; H01R 2103/00; H01R 4/185; H01R 43/058; H01R 43/05; H01R 43/052; H01R 13/02; H01B 13/06; H01B 7/0009; H01B 7/08; H01B 14/00; Y10T 29/53235; Y10T 29/53217; Y10T 29/49185

See application file for complete search history.

(56) References Cited

U.S. PATENT DOCUMENTS

| | | | | |
|---|---|---|---|---|
| 4,796,358 | A | 1/1989 | Long, Jr. et al. | |
| 7,125,295 | B2 * | 10/2006 | Zhao | H01R 11/12 439/883 |
| 2016/0172786 | A1 * | 6/2016 | Sussman | H01R 43/048 439/449 |
| 2017/0162954 | A1 * | 6/2017 | Nickel | H01R 4/185 |

(Continued)

FOREIGN PATENT DOCUMENTS

| | | | | |
|---|---|---|---|---|
| CN | 106067646 B | * | 3/2019 | H01R 43/28 |
| JP | 1-81891 U | | 5/1989 | |

(Continued)

*Primary Examiner* — Peter Dungba Vo
*Assistant Examiner* — Jose K Abraham
(74) *Attorney, Agent, or Firm* — Sughrue Mion, PLLC

(57) ABSTRACT

A multicore cable manufacturing method for manufacturing a multicore cable with reduced influence on high-frequency characteristics is provided. The multicore cable manufacturing method includes a plurality of crimping dies, each crimping die being constituted of a pair of dies to connect, by crimping, each electric wire and each terminal. The plurality of crimping dies is configured to substantially simultaneously connect the plurality of electric wires and the plurality of terminals, and the crimping die is configured to connect a front end portion of each electric wire and each terminal with the front end portions of the plurality of electric wires extending radially centering on a branch point located on a rear side of the front end portion.

1 Claim, 6 Drawing Sheets

(56) References Cited

U.S. PATENT DOCUMENTS

| | | | | |
|---|---|---|---|---|
| 2017/0179616 | A1* | 6/2017 | Anma | H01R 43/048 |
| 2017/0201051 | A1* | 7/2017 | Yamamoto | H01R 4/185 |

FOREIGN PATENT DOCUMENTS

| | | | | | |
|---|---|---|---|---|---|
| JP | 7-272818 | A | | 10/1995 | |
| JP | 2010-003429 | A | | 1/2010 | |
| JP | 2010003429 | A | * | 1/2010 | H01R 43/048 |
| JP | 2014-220215 | A | | 11/2014 | |

* cited by examiner

MULTICORE CABLE MANUFACTURING METHOD

CROSS-REFERENCE TO RELATED APPLICATION

The priority application Japanese Patent Application No. 2017-247617 upon which this patent application is based is hereby incorporated by reference.

FIELD OF THE INVENTION

The present invention relates to a multicore cable manufacturing apparatus and a multicore cable manufacturing method.

BACKGROUND

One example of a terminal crimping method for a flat multicore electric wire is disclosed in Japanese Patent Application Publication No. 2010-3429. This method includes passing, into a collectively pitch-equalizing member, respective core wires of a plurality of covered electric wires with one end portions of the core wires covered by an insulation sheath and such that another end portions of the core wires are exposed, and bending the respective core wires such that the core wires at the another end portions are arranged at a substantially constant interval with respect to each other. In this condition, conductors of the respective core wires and terminals are connected by crimping.

In such conventional flat multicore electric wire, a crimping device for connecting, by crimping, the conductor of each core wire and the terminal includes an upper die crimper having two curved faces extending in a recessed manner and a lower die anvil having a curved face extending in a recessed manner.

Japanese Patent Application Publication No. 2014-220215 discloses a terminal crimped electric wire manufacturing apparatus in which a crimping device includes a plurality of upper die crimpers arranged in line in a direction orthogonal to an axis of a flat multicore electric wire (i.e., a width direction), and a plurality of lower die anvils. In the plurality of upper die crimpers, each curved face extends in parallel to a direction orthogonal to a width of the flat multicore electric wires. Similarly, in the plurality of lower die anvils, each curved face extends in parallel to the direction orthogonal to the width of the flat multicore electric wires.

SUMMARY OF THE INVENTION

However, the conventional terminal crimping method as disclosed in Japanese Patent Application Publication No. 2010-3429 has a drawback as described below. That is, for example, as shown in FIG. 6, in the flat multicore electric wire obtained with this method, each core wire is bent at a predetermined portion S1 of the core wire to arrange the plurality of core wires 102 at a substantially constant interval with respect to each other. Thus, of the plurality of core wires 102, especially the core wires 102 on both ends are provided with fork-shaped bends due to the bending of the predetermined portions S1. This fork-shaped bends on the core wires 102 cause a relatively large interval L0 between the core wires 102, and this relatively large interval L0 could influence on high-frequency characteristics of the respective core wires 102.

An object of the present invention is to provide a multicore cable manufacturing apparatus and a multicore cable manufacturing method for manufacturing a multicore cable with reduced influence on high-frequency characteristics.

To achieve the above-mentioned object, the present invention according to a first aspect provides a multicore cable manufacturing apparatus for manufacturing a multicore cable that includes a plurality of electric wires, an insulation member collectively covering the plurality of electric wires so as to expose front end portions of the plurality of electric wires and a plurality of terminals connected to the front end portions of the plurality of electric wires, the multicore cable manufacturing apparatus including, a plurality of crimping dies, each crimping die being constituted of a pair of dies to connect, by crimping, each of the electric wires and each of the terminals, wherein, the plurality of crimping dies is configured to substantially simultaneously connect, by crimping, the plurality of electric wires and the plurality of terminals, and the plurality of crimping dies is configured to connect, by crimping, the front end portion of each electric wire and each terminal with the front end portions of the plurality of electric wires extending radially centering on a branch point located on a rear side of the front end portion.

According to a second aspect of the present invention, at least one of the pair of dies constituting the crimping die includes a curved face formed so as to extend linearly to place the front end portion of each electric wire or each terminal, and during the crimping connection of each electric wire and each terminal, an extending direction of the plurality of curved faces is oriented along a radial direction centering on the branch point of the plurality of electric wires.

The present invention according to a third aspect provides a multicore cable manufacturing method for manufacturing a multicore cable that includes a plurality of electric wires, an insulation member collectively covering the plurality of electric wires so as to expose front end portions of the plurality of electric wires, and a plurality of terminals connected to the front end portions of the plurality of electric wires, the terminal including an electric contact portion to be connected to a mating terminal and an electric wire connection portion arranged continuous with the electric contact portion, the multicore cable manufacturing method including steps of: arranging the plurality of terminals such that the electric contact portion is located on a front side and the electric wire connection portion is located on a rear side, and that a longitudinal direction in which the electric contact portion and the electric wire connection portion are continuously arranged is oriented along a radial direction centering on a predetermined imaginary point; bending the plurality of electric wires at the imaginary point such that the front end portions of the plurality of electric wires extend radially centering on the imaginary point; positioning each terminal and each electric wire such that the longitudinal direction of each terminal and an axis of the front end portion of each electric wire are aligned in a straight line; and connecting, by crimping, each terminal and each electric wire.

According to the present invention described above, the multicore cable manufacturing apparatus includes the plurality of crimping dies each constituted of the pair of dies to connect, by crimping, each electric wire and each terminal, and the crimping die connects, by crimping, the front end portion of each electric wire and each terminal with the front end portions of the plurality of electric wires extending radially centering on the branch point located on the rear side of the front end portion. Thus, the plurality of electric wires is subjected to the crimping connection with the electric wires bent gently such that an interval between the electric wires is increased gradually from the branch point toward the front end portion. Consequently, unlike the conventional art, the electric wires can be prevented from being bent in the fork shape, avoiding the creation of the relatively large interval between the electric wires. As a result, the multicore cable with reduced influence on the high-frequency characteristics can be manufactured. Furthermore, since the plurality of crimping dies is configured to connect, by crimping, the plurality of electric wires and the plurality of terminal at substantially the same time, the configuration of the control part that controls the plurality of crimping dies can be simplified while improving productivity.

Furthermore, according to the present invention described above, in the step of arranging the plurality of terminals the terminals are arranged such that the electric contact portion is located on the front side and the electric wire connection portion is located on the rear side, and that the longitudinal direction in which the electric contact portion and the electric wire connection portion are continuously arranged is oriented along the radial direction centering on the predetermined imaginary point, and in the step of bending the plurality of electric wires the plurality of electric wires is bent at the imaginary point such that the front end portions of the plurality of electric wires extend radially centering on the imaginary point, and in the step of positioning, each terminal and each electric wire are positioned such that the longitudinal direction of each terminal and the axis of the front end portion of each electric wire are aligned in the straight line, and in the step of connecting, each terminal and each electric wire are connected by crimping. Thus, the plurality of electric wires is connected with the electric wires bent gently such that an interval between the electric wires is increased gradually from the branch point toward the front end portion. Consequently, unlike the conventional art, the electric wires can be prevented from being bent in the fork shape, avoiding the creation of the relatively large interval between the electric wires. As a result, the multicore cable with reduced influence on the high-frequency characteristics can be manufactured.

DETAILED DESCRIPTION OF EXEMPLARY EMBODIMENTS

Figure 1:
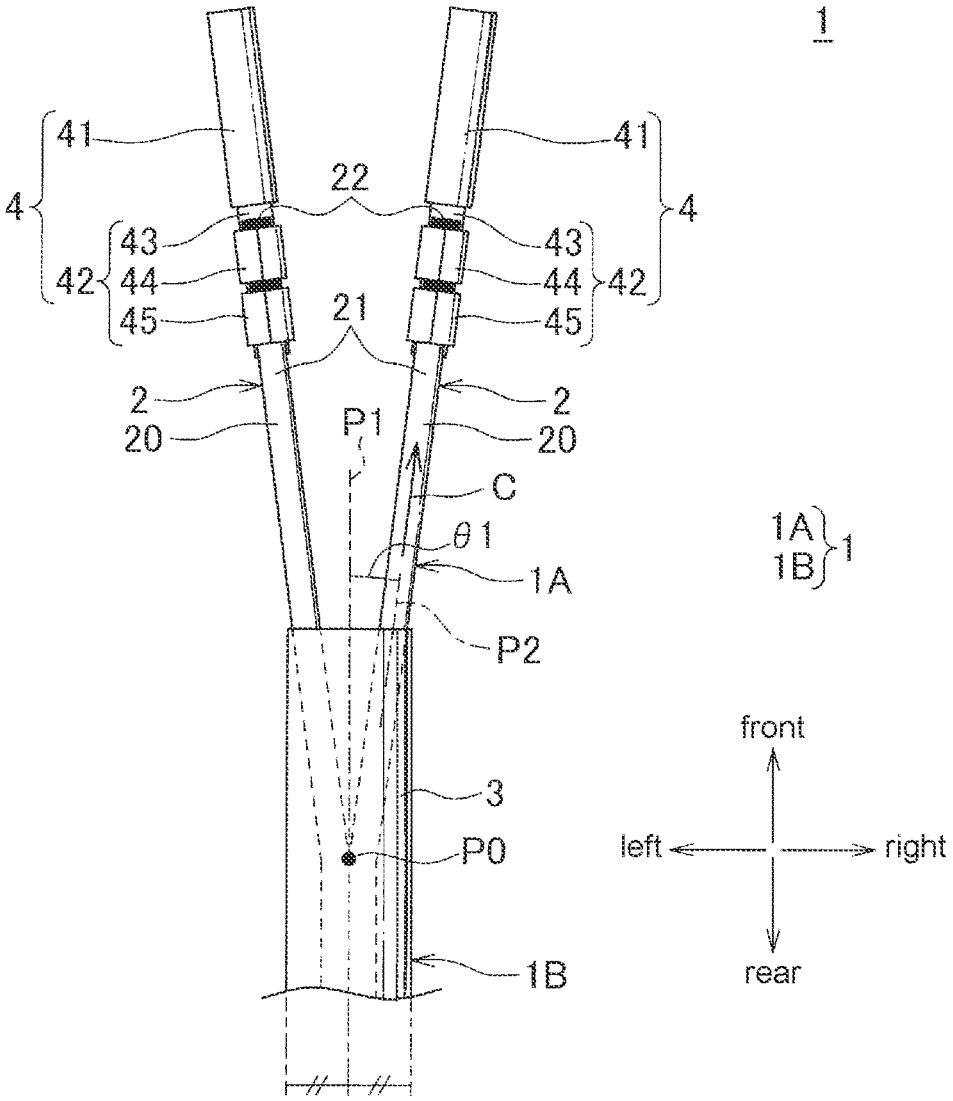
FIG. 1 is a plane view of a multicore cable manufactured using a multicore cable manufacturing apparatus according to one embodiment of the present invention.

The following will explain an exemplary embodiment of the present invention in reference to the drawings. FIG. 1 is a plane view of a multicore cable manufactured using a multicore cable manufacturing apparatus according to one embodiment of the present invention Multicore Cable As shown in FIG. 1, a multicore cable 1 includes a plurality (two, in the shown example, and hereinafter described as a pair) of covered electric wires 2 (hereinafter called the electric wires 2), an insulation sheath 3 (insulation member) which collectively covers rear side of the pair of electric wires 2 so as to expose front end portions 20 of the pair of electric wires 2, a plurality (two, in the shown example, and hereinafter described as a pair) of terminals 4 configured to be connected, by crimping, to the front end portions 20 of the respective electric wires 2. Herein, the side of the multicore cable 1 on which the terminal 4 is attached is referred to as "front", and the opposite side of the multicore cable 1 on which the insulation sheath 3 is provided is referred to as "rear". Further, a direction orthogonal to the front-rear direction is referred to as a right-left direction.

In the multicore cable 1, the pair of electric wires 2 is provided on a plane including the front-rear direction and the right-left direction. In the multicore cable 1, the pair of electric wires 2 is provided with the front end portions 20 extending radially centering on a later-described branch point P0 (a predetermined imaginary point). In this embodiment, a portion of the multicore cable 1 located on the front of the branch point P0 is referred to as "front side portion 1A", and a portion of the multicore cable 1 located on the rear of the branch point P0 is referred to as "rear side portion 1B". Although the multicore cable 1 includes the pair of electric wires 2 in this embodiment, it may include three or more electric wires in an alternative embodiment.

As shown in FIG. 1, the branch point P0 is located on the rear side of the front end portion 20 of each electric wire 2 where the electric wires 2 are covered by the insulation sheath 3. Further, the branch point P0 is located on a center axis P1 of the insulation sheath 3 in a top view of the multicore cable 1.

In the rear side portion 1B, the pair of electric wires 2 is provided close to each other such that their axes extend along the front-rear direction. In the front side portion 1A, the pair of electric wires 2 is bent gently such that an interval between the electric wires 2 is increased gradually from the branch point P0 toward the front. That is, each electric wire 2 is bent at the branch point P0 and extends linearly from the branch point P0 to the front end portion 20. In this embodiment, the pair of electric wires 2 is bent such that an angle between the imaginary line P1 extending frontward from the branch point P0 and an axis extending direction P2 of each electric wire 2 of the front side portion 1A forms a predetermined angle θ1. The imaginary line P1 (since the imaginary line is on the same location as the center axis P1 of the insulation sheath 3, the same reference sign is used) is an extension line of the center axis P1 of the insulation sheath 3. Hereinafter, in the front side portion 1A, the axis extending direction P2 of each electric wire 2 with respect to the imaginary line P1 is referred to as "branch direction C".

The insulation sheath 3 is peeled for a predetermine length from a front end of the multicore cable 1, thereby the front end portions 20 of the pair of electric wires 2 are exposed.

Each of the two terminals 4 is constituted of a tubular electric contact portion 41 into which a mating terminal (not shown) is to be inserted and connected, and an electric wire connection portion 42 which is arranged continuous with the electric contact portion 41 and to which the electric wire 2 is to be mechanically and electrically connected. In this embodiment, the terminal 4 is illustrated as a female terminal having the tubular electric contact portion 41 to which the mating terminal is inserted and connected, as one example. However, the terminal may be a male terminal having a tab-like electric contact portion.

Figure 3A:
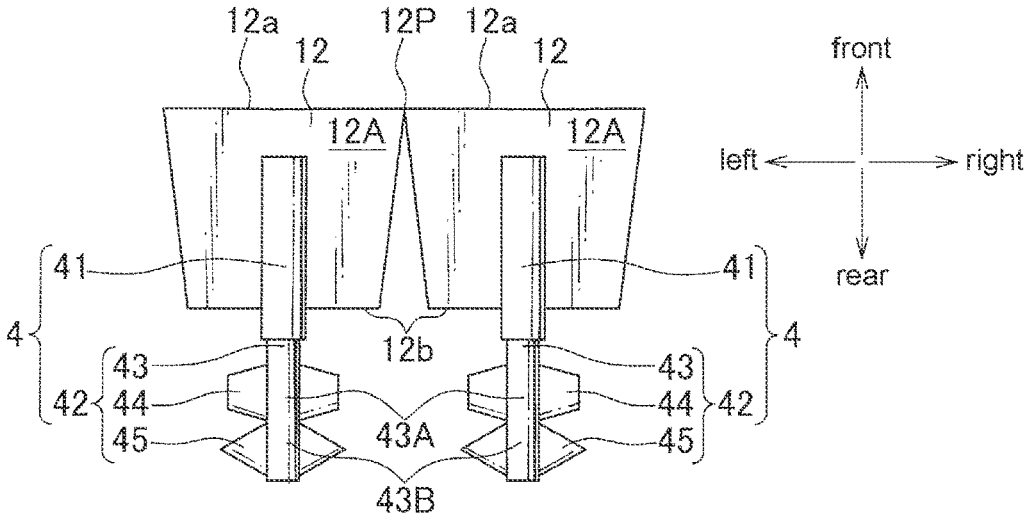
FIG. 3A is a plane view illustrating a manufacturing step of the multicore cable, showing a state in which a terminal is held by a terminal holder.

As shown in FIG. 3A, the electric wire connection portion 42 includes a rectangular plate-shaped base portion 43, a pair of conductor crimping pieces 44 configured to crimp a conductor portion 22 of the electric wire 2 which is exposed by peeling a cover portion 21 of the electric wire 2, and a pair of cover crimping pieces 45 configured to crimp the cover portion 21 of the electric wire 2. A location on the base portion 43 on which the conductor portion 22 of the electric wire 2 is placed is referred to as a conductor installation location 43A, and a location on the base portion 43 on which the cover portion 21 of the electric wire 2 is placed is referred to as a cover installation location 43B. The cover installation location 43B is located in the rear of the conductor installation location 43A in a longitudinal direction of the terminal 4. The pair of conductor crimping pieces 44 stands up (i.e., extends upward) from both ends of the conductor installation location 43A located in a widthwise direction of the conductor installation location 43A of the base portion 43 (i.e., the right-left direction), so as to face each other. The pair of cover crimping pieces 45 stands up from both ends of the cover installation location 43B in a widthwise direction of the cover installation location 43B of the base portion 43 (i.e., the right-left direction), so as to face each other.

Multicore Cable Manufacturing Apparatus

As shown in FIGS. 2A, 2B, 3A and 3B, a multicore cable manufacturing apparatus 10 includes an applicator 11 configured to connect, by crimping, the end portion of each electric wire 2 and each terminal 4, a driving source (not shown) configured to drive the applicator 11, and a control part (not shown) configured to control the driving source.

As shown in FIGS. 2A, 2B, 3A and 3B, the applicator 11 includes a pair of terminal holders 12 (shown in FIGS. 3A and 3B) configured to hold the pair of terminals 4, respectively, and a crimping die 13 (shown in FIGS. 2A and 2B) configured to connect, by crimping, the end portion of each electric wire 2 and each terminal 4 supported by the terminal holder 12.

Figure 3B:
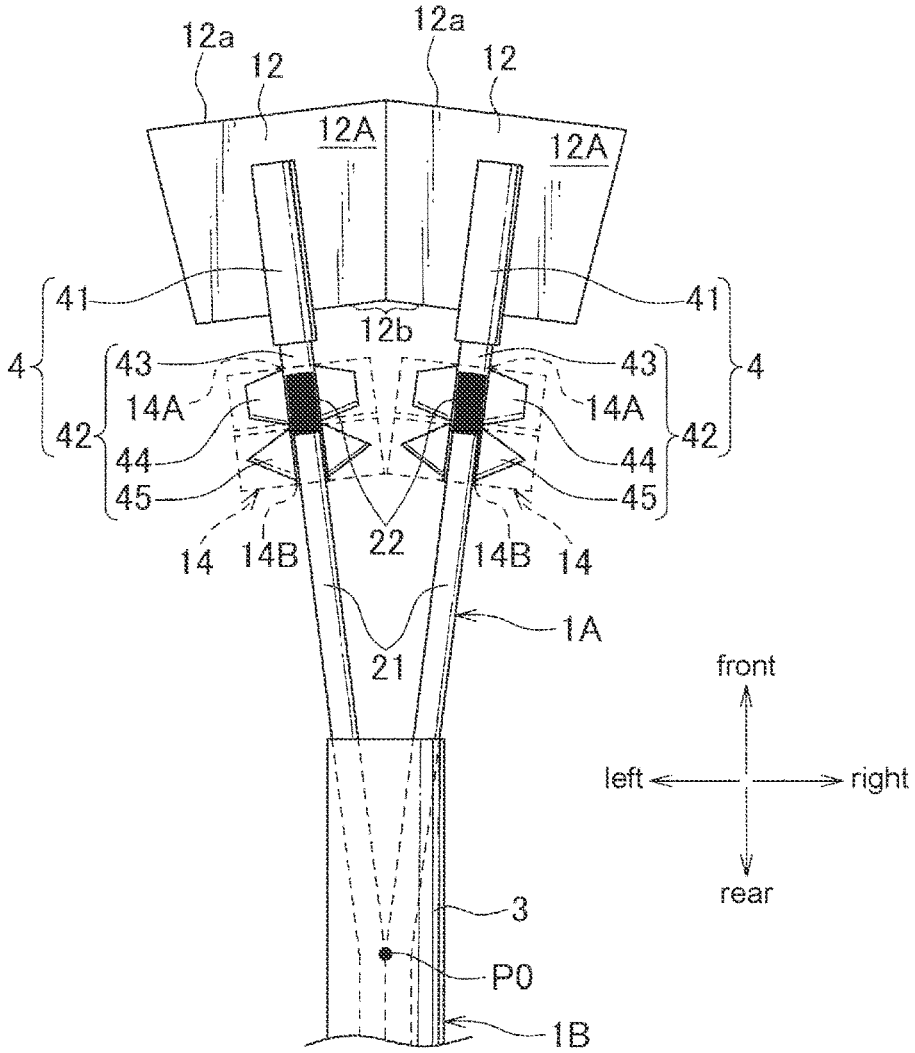
FIG. 3B illustrates a step after FIG. 3A, showing a state in which a longitudinal direction of each terminal and an axis of a front end portion of each electric wire are arranged in a straight line.

As shown in FIGS. 3A and 3B, each terminal holder 12 includes a placement face 12A configured to place and hold each terminal 4. Each placement face 12A is formed into an isosceles trapezoid shape in a top view. Each placement face 12A has the isosceles trapezoid shape in a top view and is arranged such that, of a pair of parallel opposite sides 12*a* and 12*b*, the long side 12*a* is located on the front side, and the short side 12*b* is located on the rear side. The pair of placement faces 12A is arranged capable of being displaced, around a rotation center which is a contact point 12P of ends of the long sides 12*a* of the respective placement faces 12A, between a separated position in which ends of the short sides 12*b* of the respective placement faces 12A are separated from each other, and a contact position in which the ends of the short sides 12*b* of the respective placement faces 12A are in contact with each other.

Each terminal holder 12 is configured to hold the electric contact portion 41 with the electric contact portion 41 placed on the placement face 12A. In a state in which the terminal 4 is placed on the placement face 12A, the electric wire connection portion 42 projects rearward from the short side 12*b* of the placement face 12A with its longitudinal direction orthogonal to the short side 12*b* of the placement face 12A. The pair of terminal holders 12 is configured such that, in the separated position as shown in FIG. 3A, an alignment direction in which the electric contact portion 41 and the electric wire connection portion 42 of each terminal 4 are aligned (hereinafter described as the longitudinal direction of the terminal 4) is oriented along the front-rear direction, and in the contact position as shown in FIG. 3B, each terminal 4 is held with its longitudinal direction slanted with respect to the front-rear direction at a predetermined angle θ1. Thus, when the pair of terminal holders 12 is in the contact position, the pair of terminals 4 is arranged such that their longitudinal directions are oriented along the radial direction centering on the branch point P0.

Figure 2A:
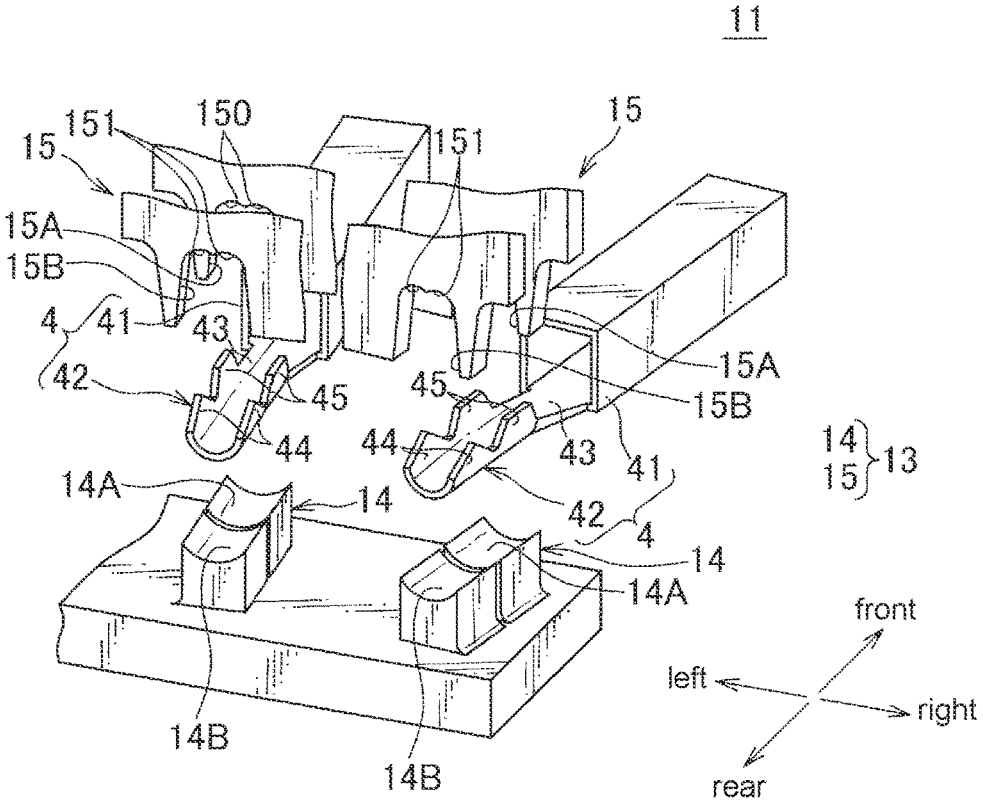
FIG. 2A is a perspective view of the multicore cable manufacturing apparatus.
Figure 2B:
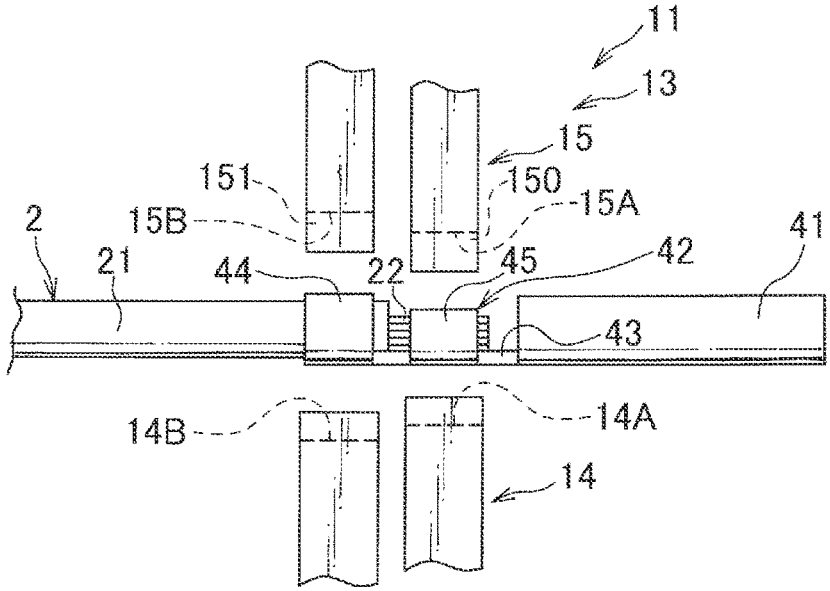
FIG. 2B is a side view of FIG. 2A.

As shown in FIGS. 2A and 2B, the crimping die 13 includes an anvil 14 and a crimper 15 configured to sandwich in a vertical direction and connect the end portion of each electric wire 2 and each terminal 4. That is, the crimping die 13 includes the anvil 14 and the crimper 15 which together form a pair (i.e., the crimping die 13 includes the pair of dies, i.e., the pair of anvil 14 and crimper 15). Thus, the crimping dies 13, i.e., the pairs of anvils 14 and crimpers 15, is configured to substantially simultaneously connect the end portion of each electric wire 2 and each terminal 4, allowing to substantially simultaneously manufacturing the pair of electric wires 2 attached with the pair of terminals 4.

As shown in FIGS. 2A and 2B, each anvil 14 is provided with an anvil front side curved face 14A configured to place the conductor installation location 43A of the base portion 43 of each terminal 4, and an anvil rear side curved face 14B configured to place the cover installation location 43B of the base portion 43 of each terminal 4.

The anvil front side curved face 14A and the anvil rear side curved face 14B are formed into a circular arc shape centering on the axis of the front end portion 20 of each electric wire 2. Further, the anvil front side curved face 14A and the anvil rear side curved face 14B are formed to have substantially the same shape at any locations in the axis extending direction of the front end portion 20 of the electric wire 2. The anvil front side curved face 14A and the anvil rear side curved face 14B are positioned in line along the axial direction of the front end portion 20 of each electric wire 2, and the anvil front side curved face 14A is provided in front of the anvil rear side curved face 14B in the axial direction of the front end portion 20 of the electric wire 2. In other words, each of the anvil front side curved face 14A and the anvil rear side curved face 14B is formed so as to extend in the branch direction C.

As shown in FIGS. 2A and 2B, each crimper 15 includes a crimper front side curved face 15A positioned above the anvil front side curved face 14A and configured to crimp the pair of conductor crimping pieces 44, and a crimper rear side curved face 15B positioned above the anvil rear side curved face 14B and configured to respectively crimp the pair of cover crimping pieces 45.

The crimper front side curved face 15A includes a pair of front side arcuate portions 150 configured to bend distal ends of the pair of conductor crimping pieces 44 toward the central axis of each electric wire 2, respectively, to crimp the conductor portion 22 of each electric wire 2. Each front side arcuate portion 150 is formed into a circular arc shape and is formed to have the substantially same shape at any locations in the axis extending direction of the front end portion 20 of the electric wire 2. That is, each front side arcuate portion 150 is formed so as to extend in the branch direction C.

The crimper rear side curved face 15B includes a pair of rear side arcuate portions 151 configured to bend distal ends of the pair of cover crimping pieces 45 toward the central axis of each electric wire 2, respectively, to crimp the cover portion 21 of each electric wire 2. Each rear side arcuate portion 151 is formed into a circular arc shape and is formed to have the substantially same shape at any locations in the axis extending direction of the front end portion 20 of the electric wire 2. That is, each rear side arcuate portion 151 is formed so as to extend in the branch direction C.

In the multicore cable manufacturing apparatus 10, the driving source is driven according to instruction from the control part, thereby the two crimpers 15 are substantially simultaneously moved downward toward the anvils 14 so the pair of terminals 4 is substantially simultaneously crimped to the pair of electric wires 2, respectively. That is, four portions of the pair of electric wires 2 including the cover portions 21 and the conductor portions 22 of the respective electric wires 2 are subjected to the crimping connection at substantially the same time. When the two crimpers 15 are moved downward toward the anvils 14 at substantially the same time, each terminal 4 is being held by each terminal holder 12 according to instruction from the control part. Once the end portion of each electric wire 2 and each terminal 4 are connected, each terminal 4 is released from each terminal holder according to instruction from the control part. In a manner as described above, the multicore cable 1 with the end portion of each electric wire 2 and each terminal 4 being connected, by crimping, is manufactured.

Figure 4:
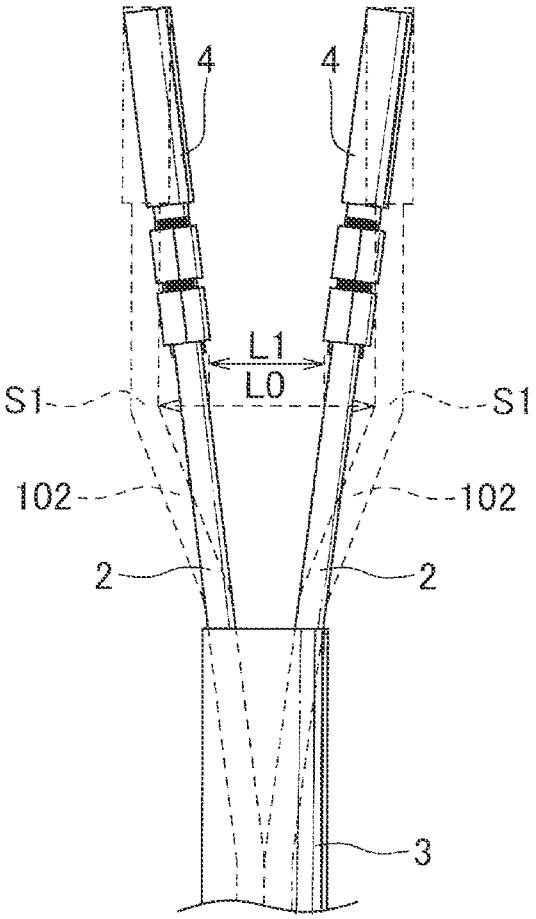
FIG. 4 illustrates an advantageous effect provided by the multicore cable manufactured using the multicore cable manufacturing apparatus according to one embodiment of the present invention.

As described above, the multicore cable manufacturing apparatus 10 includes the plurality of crimping dies 13, each crimping die 13 being constituted of a pair of dies to connect, by crimping, each electric wire 2 and each terminal 4. The crimping dies 13 connect the front end portion 20 of each electric wire 2 and each terminal 4 with the front end portions 20 of the plurality of electric wires 2 extending radially centering on the branch point P0 located on the rear side of the front end portion 20. That is, as shown in FIG. 4, the plurality of electric wires 2 is connected with the electric wires 2 bent gently such that an interval L1 between the electric wires 2 is increased gradually from the branch point P0 toward the front end portion 20. Consequently, unlike the conventional art, the electric wires can be prevented from being bent in the fork shape, avoiding the creation of a relatively large interval between the electric wires. As a result, the multicore cable 1 with reduced influence on the high-frequency characteristics can be manufactured.

Furthermore, as described above, the plurality of crimping dies 13 is configured to connect the plurality of electric wires 2 and the plurality of terminal 4 at substantially the same time. This can simplify the configuration of the control part that controls the plurality of crimping dies 13 while improving productivity.

Furthermore, as described above, for the crimping die 13 constituted of the pair of dies as described above, at least one die of the crimping die 13 includes the curved face 14A, 14B, 15A, 15B formed so as to extend linearly to place the front end portion 20 of each electric wire 2 or each terminal 4. During the crimping connection of each electric wire 2 and each terminal 4, an extending direction (i.e., the branch direction C) of the plurality of curved faces 14A, 14B, 15A, 15B is oriented along the radial direction centering on the branch point P0 of the plurality of electric wires 2. Consequently, when connecting each electric wire 2 and each terminal 4, each electric wire 2 and each terminal 4 can be connected without applying local load on the electric wire 2. As a result, the multicore cable 1 with further reduced influence on the high-frequency characteristics can be manufactured.

Multicore Cable Manufacturing Method

Figure 3C:
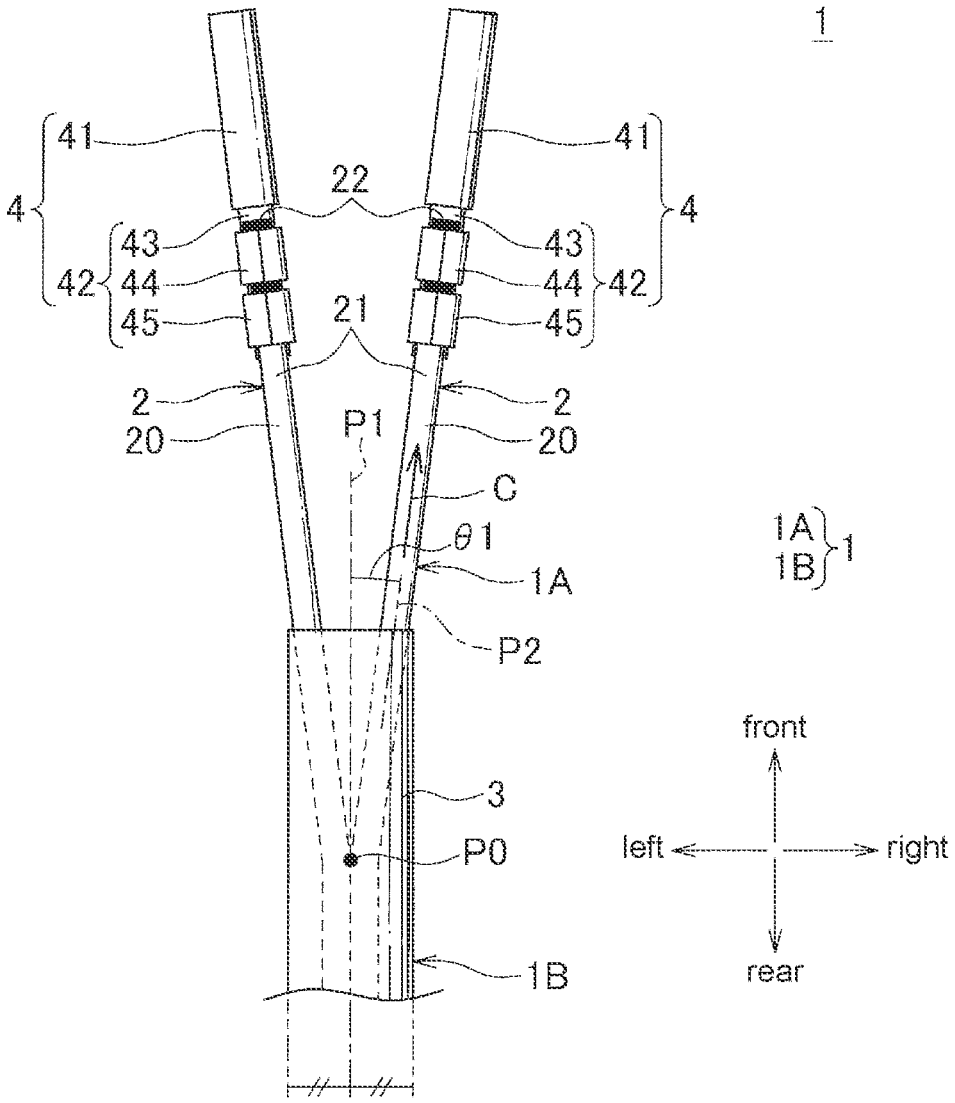
FIG. 3C is a plane view of a multicore electric wire manufactured after FIG. 3B.

Next, the following will explain a manufacturing method of the multicore cable 1 using the multicore cable manufacturing apparatus 10, in reference to FIGS. 3A, 3B and 3C. FIGS. 3A, 3B and 3C are plane views illustrating manufacturing steps of the multicore cable 1. Specifically, FIG. 3A illustrates a state in which each terminal 4 is held by the terminal holder 12. FIG. 3B illustrates a step after FIG. 3A and shows a state in which each electric wire 2 and each terminal 4 are connected. FIG. 3C illustrates a step after FIG. 3B and shows a state in which each terminal holder 12 is detached from each terminal 4.

As shown in FIG. 3A, each terminal 4 is held by each placement face 12A with the pair of terminal holders 12 positioned at the separated position. Then, the driving part is driven by the control part to displace the pair of terminal holders 12 around the rotation center which is the contact point P of the pair of terminal holders 12, to the contact position. In this manner, the pair of terminals 4 is arranged such that the electric contact portion 41 is located on the front side and the electric wire connection portion 42 is located on the rear side, and that the longitudinal direction of the terminal 4 is oriented along the radial direction centering on the predetermined imaginary point P0 (terminal arranging step). The conductor installation location 43A of the electric wire connection portion 42 of each terminal 4 is placed onto the anvil front side curved face 14A of the applicator, and the cover installation location 43B is placed onto the anvil rear side curved face 14B.

The pair of electric wires 2 is covered with the insulation sheath 3 at its rear side portion, whereas its front end portion 20 is exposed. In this condition, each electric wire 2 is bent at the predetermined branch point P0, i.e., the predetermined imaginary point P0, such that the angle between the imaginary point P0 and the axis of the front end portion 20 forms the predetermine angle θ1, as shown in FIG. 3B. Thus, the front end portions 20 of the pair of electric wires 2 extend radially centering on the branch point P0 (electric wire bending step).

The conductor portion 22 of each electric wire 2 is placed onto the conductor installation location 43A of the electric wire connection portion 42, and the cover portion 21 of each electric wire 2 is placed onto the cover installation location 43B of the electric wire connection portion 42. At this time, the branch point P0 of the pair of electric wires 2 is located on a longitudinal extension of each terminal 4 (positioning step).

In this condition, the driving part is driven by the control part to move the crimpers 15 of the crimping dies 13 downward. Between the anvil front side curved face 14A and the crimper front side curved face 15A, the pair of conductor crimping pieces 44 is bent, thereby the conductor portion 22 of each electric wire 2 and each terminal 4 are connected. At (substantially) the same time, between the anvil rear side curved face 14B and the crimper rear side curved face 15B, the pair of cover crimping pieces 45 is bent, thereby the cover portion 21 of each electric wire 2 and each terminal 4 are connected. Then, in accordance with instruction from the control part, each terminal 4 is detached from the pair of terminal holders 12. In the manner described above, the multicore cable 1 shown in FIG. 3C is manufactured.

According to the multicore cable manufacturing method, in the terminal arranging step, each terminal 4 is arranged such that the electric contact portion 41 is located on the front side and the electric wire connection portion 42 is located on the rear side, and that the longitudinal direction of the terminal 4 in which the electric contact portion 41 and the electric wire connection portion 42 are continuously arranged is oriented along the radial direction centering on the predetermined imaginary point P0. In the electric wire bending step, the plurality of electric wires 2 is bent at the imaginary point P0, such the front end portions 20 are branched radially centering on the imaginary point P0. In the positioning step, each terminal 4 and each electric wire 2 are positioned such that the longitudinal direction of each terminal 4 and the axis P2 of the front end portion 20 of each electric wire 2 are aligned in a straight line. In the crimping step, each terminal 4 and each electric wire 2 are connected. Thus, the plurality of electric wires 2 is connected with the electric wires 2 bent gently such that the interval between the electric wires 2 is increased gradually from the branch point P0 toward the front end portion 20. Consequently, the multicore cable 1 with reduced influence on the high-frequency characteristics can be manufactured.

It should be understood that the present invention is not limited to the embodiments described above, and the present invention may include other configurations that can achieve the object of the present invention including those explained in the following modifications.

Figure 5:
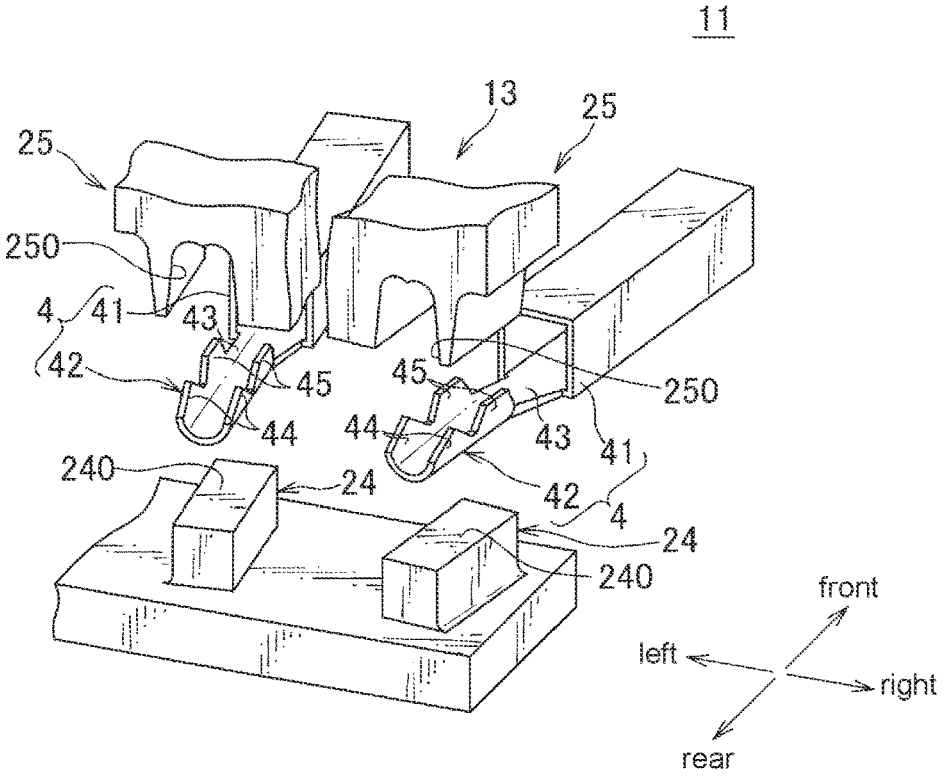
FIG. 5 is a perspective view showing a modified example of a multicore cable manufacturing apparatus of the present invention.
Figure 6:
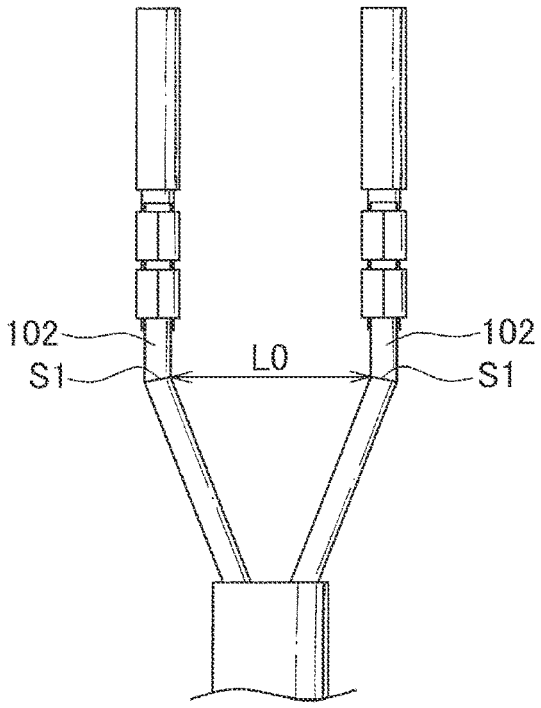
FIG. 6 is an illustration illustrating a drawback of a conventional flat multicore electric wire.

In the embodiment described above, the anvil 14 includes the anvil front side curved face 14A (curved face) and the anvil rear side curved face 14B (curved face). However, the present invention is not limited to this. As shown in FIG. 5, an anvil 25 may include a flat face 240. Thus, the anvil may not necessarily include the anvil 14 includes the anvil front side curved face 14A (curved face) and the anvil rear side curved face 14B (curved face). That is, in the multicore cable manufacturing apparatus, at least one of the anvil and the crimper includes the curved face.

Furthermore, in the embodiment described above, the crimper 15 includes the crimper front side curved face 15A and the crimper rear side curved face 15B. However, the present invention is not limited to this. As shown in FIG. 5, a crimper 25 may include a single curved face 250 that is continuous in the front-rear direction.

Furthermore, in the embodiment described above, each terminal 4 is arranged to the predetermined position in the terminal arranging step, followed by bending the plurality of electric wires 2 is bent at the imaginary point P0 such the front end portions 20 of the respective electric wires 2 are branched radially centering on the imaginary point P0. However, the present invention is not limited to this. That is, the present invention is not limited to performing the electric wire bending step after the terminal arranging step. The terminal arranging step may be performed after the electric wire bending step.

Furthermore, in the embodiment described above, two crimpers 15 are simultaneously moved downward toward the anvils 14 thereby the respective terminals 4 are crimped at substantially the same time for the pair of electric wires 2. That is, in the pair of electric wires 2, the four portions including the cover portions 21 and the conductor portions 22 of the respective electric wires 2 are subjected to the crimping at substantially the same time. However, the present invention is not limited to this. The two crimpers 15 may be driven separately so that they are moved downward sequentially by shifting timing.

Although the preferred configuration and method for implementing the present invention have been disclosed herein, the present invention is not limited to these. That is, although the present invention is shown and illustrated herein in relation to specific embodiments, various changes and modifications to the embodiments regarding shapes, materials, number or other detailed configurations are possible by a person skilled in the art without departing from the technical idea and object of the present invention. It should be understood that the descriptions that limit shapes or materials disclosed herein are used for the purpose of illustration to promote a better understanding of the present invention and are not intended to limit the present invention, and thus names of elements described herein without a part or all of the limitations of shapes or materials are within the present invention.

LIST OF REFERENCE SIGNS

1 multicore cable
10 multicore cable manufacturing apparatus
13 crimping die
14, 24 anvil
14A anvil front side curved face
14B anvil rear side curved face
15, 25 crimper
15A crimper front side curved face
15B crimper rear side curved face
2 pair of electric wires (plurality of electric wires)
20 front end portions of the plurality of electric wires
3 insulation sheath (insulation member)
4 pair of terminals (plurality of terminals)
41 electrical connection portion
42 electric wire connection portion
P0 branch point, predetermined imaginary point
C extending direction of the plurality of curved faces (branch direction)

What is claimed is:

1. A multicore cable manufacturing method for manufacturing a multicore cable that includes:

a plurality of electric wires;

an insulation member collectively covering the plurality of electric wires so as to expose front end portions of the plurality of electric wires;

a plurality of terminals connected to the front end portions of the plurality of electric wires, the terminal including an electric contact portion to be connected to a mating terminal and an electric wire connection portion arranged continuous with the electric contact portion; and a plurality of terminal holders configured to hold the plurality of terminals, the multicore cable manufacturing method comprising steps of:

arranging the plurality of terminals such that the electric contact portion is located on a front side and the electric wire connection portion is located on a rear side, and that a longitudinal direction, in which the electric contact portion and the electric wire connection portion are continuously arranged, is oriented along a radial direction centering on a predetermined imaginary point;

bending the plurality of electric wires at the imaginary point such that the front end portions of the plurality of electric wires extend radially in an extending direction centering on the imaginary point;

positioning each terminal and each electric wire such that a longitudinal direction of each terminal and an axis of the front end portion of each electric wire are aligned in a straight line;

positioning each terminal in each terminal holder such that a short side of the terminal holder comes into contact with a short side of an adjacent terminal holder in order to position each terminal and each electric wire in the straight line; and connecting, by crimping, each terminal and each electric wire.

* * * * *